US006950029B2

(12) United States Patent
Enzinna

(10) Patent No.: US 6,950,029 B2
(45) Date of Patent: Sep. 27, 2005

(54) AIRFLOW BLOCKAGE DETECTION APPARATUS FOR A PERMANENT SPLIT-CAPACITOR SINGLE-PHASE FAN MOTOR

(75) Inventor: Donald John Enzinna, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 73 days.

(21) Appl. No.: 10/602,382

(22) Filed: Jun. 24, 2003

(65) Prior Publication Data

US 2004/0263341 A1 Dec. 30, 2004

(51) Int. Cl.[7] ..... G08B 21/00

(52) U.S. Cl. ..... 340/607; 340/501; 340/608; 340/648; 340/664; 318/78; 318/613; 361/31

(58) Field of Search ..... 340/640, 607, 340/608, 507, 509, 510, 648, 649, 664, 501; 318/78, 613, 804, 254; 454/22, 20; 417/221; 62/640; 361/30, 31, 35, 37; 388/854, 903

(56) References Cited

U.S. PATENT DOCUMENTS 5,478,379 A * 12/1995 Bevins ..... 96/119
5,831,525 A * 11/1998 Harvey ..... 340/507
6,545,438 B1 * 4/2003 Mays, II ..... 318/254

* cited by examiner

*Primary Examiner*—Davetta W. Goins
(74) *Attorney, Agent, or Firm*—Patrick M. Griffin

(57) ABSTRACT

An airflow blockage detection apparatus for a permanent split-capacitor single-phase cooling fan motor measures and compares electrical currents in main and auxiliary windings of the motor to detect airflow blockage. Main and auxiliary current sensors detect AC currents in the main and auxiliary windings, respectively, and a blockage detection circuit forms a difference between the detected currents. An airflow blockage alarm is activated when the current difference exceeds a specified setpoint indicative of abnormally low airflow.

3 Claims, 1 Drawing Sheet

AIRFLOW BLOCKAGE DETECTION APPARATUS FOR A PERMANENT SPLIT-CAPACITOR SINGLE-PHASE FAN MOTOR

TECHNICAL FIELD

This invention relates to apparatus for monitoring the operation of a fan motor, and more particularly to an electrical circuit for detecting fan airflow blockage when the motor is a split-capacitor single-phase induction motor.

BACKGROUND OF THE INVENTION

Cooling fans for heat-sensitive electrical equipment are frequently driven by single-phase induction motors having main and auxiliary windings with one or more capacitors connected in series with the auxiliary winding. Such motors, sometimes referred to as permanent split-capacitor motors because the capacitor is continuously in series with the auxiliary winding, are widely used in cooling fan applications due to their low cost of manufacture and starting ease. In many cases, it is necessary to provide an indication of cooling loss should the fan airflow become blocked by accumulation of dust or foreign objects. Mechanical airflow sensors such as vane switches are known, of course, but such switches require periodic calibration and are not particularly reliable. Accordingly, what is needed is more reliable and trouble-free apparatus for detecting airflow blockage.

SUMMARY OF THE INVENTION

The present invention is directed to an improved airflow blockage detection apparatus for a permanent split-capacitor single-phase cooling fan motor, where electrical currents in main and auxiliary windings of the motor are measured and compared to detect airflow blockage. Main and auxiliary current sensors detect AC currents in the main and auxiliary windings, respectively, and a bridge circuit forms a difference between the detected currents. An airflow blockage alarm is activated when the difference exceeds a specified set-point indicative of abnormally low airflow.

DESCRIPTION OF THE PREFERRED EMBODIMENT

Figure 1:
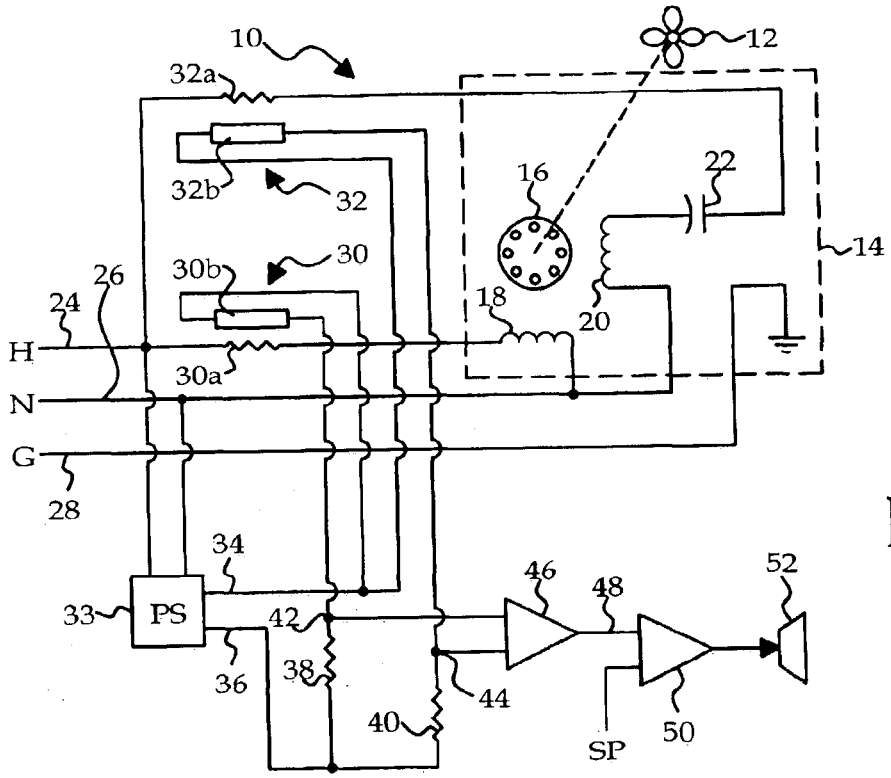
FIG. 1 is a block diagram of a fan blockage detection circuit for a permanent split-capacitor single-phase cooling fan motor according to this invention.

Referring to the drawings, and particularly to FIG. 1, the reference numeral 10 generally designates an airflow blockage detection circuit for a cooling apparatus including a fan 12 and a permanent split-capacitor single-phase induction motor 14. The motor 14 has a rotor 16 mechanically coupled to the fan 12, a stator supporting main and auxiliary electrical windings 18 and 20, and a capacitor 22 (which may be external or internal) connected in series with the auxiliary winding 20. The single-phase AC power supply for motor 14 includes hot (H), neutral (N) and ground (G) wires 24, 26, 28. The hot (H) and neutral (N) wires 24, 26 are connected across both the main winding 18 and the series combination of auxiliary winding 20 and capacitor 22, and the ground (G) wire 28 is connected to the motor housing.

In the illustrated embodiment, the main and auxiliary AC winding currents Imain, Iaux are measured with sensors 30, 32 responsive to the root-mean-square (RMS) winding currents Imain_rms, Iaux_rms in the main and auxiliary windings, respectively. Each of the sensors 30, 32 includes a precision resistor 30*a*, 32*a* connected in series between the hot (H) power supply wire 24 and the respective winding 18, 20, and a thermistor 30*b*, 32*b* disposed in close proximity to the respective resistor 30*a*, 32*a*. The resistors 30*a*, 32*a* each have an electrical resistance on the order of approximately 2 ohms, for example, and dissipate power in the form of heat due to the respective winding currents Imain, Iaux so that the temperature rises detected by the respective thermistors 30*b*, 32*b* provide a measure of the respective RMS winding currents Imain_rms, Iaux_rms. For purposes of the present invention, however, it is not necessary to know the magnitude of either Imain or Iaux, only their difference since airflow blockage is indicated by a winding current difference in excess of a calibrated setpoint SP.

Figure 2:
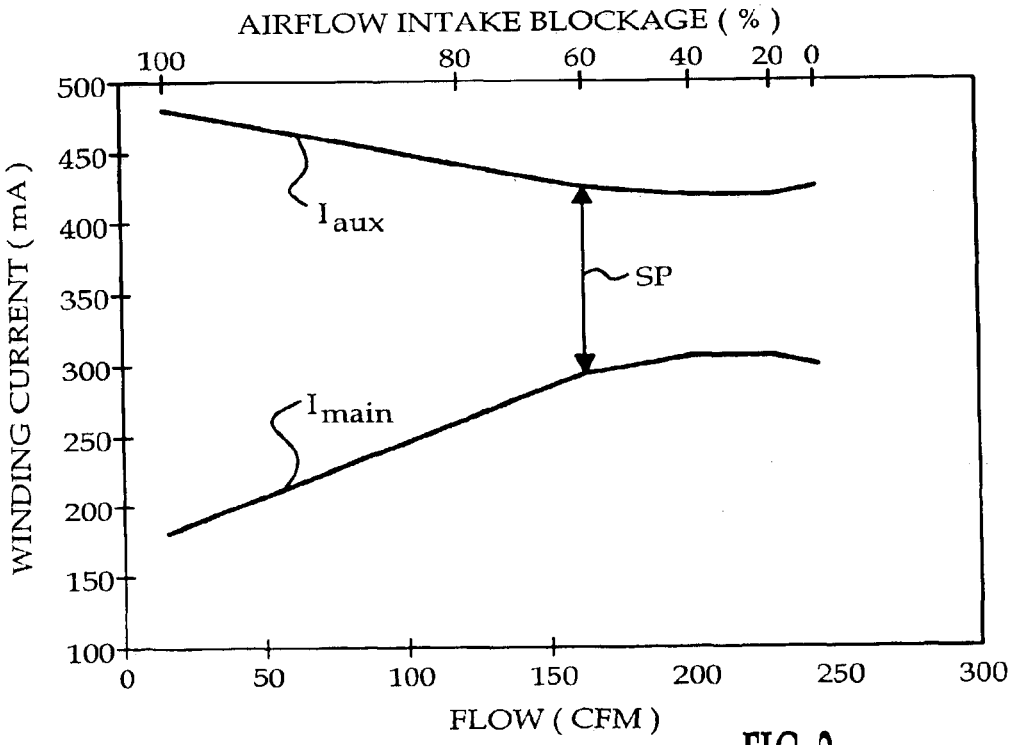
FIG. 2 is a graph depicting main and auxiliary windings currents of the motor of FIG. 1 for various degrees of airflow blockage.

The relationship of the AC winding currents Imain and Iaux for a given forced-air cooling system and various degrees of airflow blockage is graphically depicted in FIG. 2. The data was obtained by variably restricting inlet airflow area (Airflow Intake Blockage), and measuring the resulting airflow (Flow) and winding currents (Imain, Iaux). For the test system, a current differential of approximately 120 mA is observed for airflow blockages of approximately 0%–50%. However, the currents Imain and Iaux diverge as the blockage increases above 50%, with Imain decreasing and Iaux increasing. In the illustrated example, the highest degree of divergence occurs with blockage above 60%, allowing the setpoint SP to be calibrated substantially as shown in FIG. 2 to provide reliable detection of airflow blockage in excess of 60%.

Referring again to FIG. 1, the detection circuit 10 includes a power supply (PS) 33 connected across the hot (H) and neutral (N) wires 24, 26 for supplying a low-level DC voltage (such as 5 volts, for example) across lines 34 and 36. The thermistors 30*b*, 32*b* are coupled across the power supply output lines 34, 36 through respective shunt resistors 38, 40, defining measurement junctions 42, 44. Since the electrical resistances of thermistors 30*b* and 32*b* vary with their temperatures, which in turn vary with the RMS winding currents Imain_rms and Iaux_rms, the voltages at measurement nodes 42 and 44 provide an indication of the RMS currents Imain_rms and Iaux_rms. The nodes 42 and 44 are coupled to a bridge amplifier 46, which provides a signal on line 48 indicative of the winding current difference (Iaux_rms−Imain_rms). The winding current difference signal on line 48 is supplied along with a calibrated setpoint SP to a hysteresis comparator 50, which activates an alarm 52 if the current difference signal exceeds the setpoint SP.

In summary, this invention provide a reliable and inexpensive apparatus for detecting significant airflow blockage and issuing a warning to prevent overheating of heat-sensitive equipment such as electronic and computer circuitry. While described in reference to the illustrated embodiment, it is expected that various modifications in addition to those mentioned above will occur to those skilled in the art. For example, it is possible to measure average or peak-to-peak currents instead of RMS currents, and the current sensors 30, 32 will vary accordingly. For example, the sensors 30, 32 may be inductively or capacitively coupled to the lines 24, 26, or the currents may be detected by simply measuring and rectifying the voltage across a series resistor. Also, the winding current difference may be detected directly in the inductivel coupled approach, if desired. Various other measurement techniques are also possible. Additionally, some or all of the signal processing may be performed by a suitably programmed microprocessor, if desired. Thus, it will be understood that circuitry incorporating these and other modifications may fall within the scope of this invention, which is defined by the appended claims.

What is claimed is:

1. Apparatus for detecting airflow blockage of a fan that is driven by a permanent split-capacitor single-phase AC motor having a main winding and an auxiliary winding, the apparatus comprising:

main sensor means for detecting an AC current in said main winding;

auxiliary sensor means for detecting an AC current in said auxiliary winding;

means for detecting a difference between the AC currents detected by said main and auxiliary sensor means; and alarm means for indicating an airflow blockage of said fan when the detected difference exceeds a specified set-point.

2. The apparatus of claim 1, wherein at least one of said main and auxiliary sensor means comprises a resistor connected in series with its respective winding, and a thermistor thermally coupled to said resistor for measuring the heating of said resistor due to current in the respective winding.

3. The apparatus of claim 1, wherein said main and auxiliary sensor means each comprise a resistor connected in series with the respective main and auxiliary winding, and a thermistor having a resistance that varies in relation to an RMS value of said AC current in the respective winding, and wherein said means for detecting a difference includes a bridge circuit coupled to said thermistors.

* * * * *